US009033677B2

(12) United States Patent
Cogle et al.

(10) Patent No.: US 9,033,677 B2
(45) Date of Patent: May 19, 2015

(54) FIRE HOSE ADAPTER AND METHOD OF USE

(76) Inventors: Zachary Cogle, Cresent Hills, CA (US); Thomas Andrew Brenzovich, Greenville, CA (US)

( * ) Notice: Subject to any disclaimer, the term of this patent is extended or adjusted under 35 U.S.C. 154(b) by 595 days.

(21) Appl. No.: 13/236,614

(22) Filed: Sep. 19, 2011

(65) Prior Publication Data

US 2013/0068317 A1 Mar. 21, 2013

(51) Int. Cl.

| | |
|---|---|
| ***A62C 33/02*** | (2006.01) |
| ***F04F 5/20*** | (2006.01) |
| ***A62C 33/00*** | (2006.01) |

(52) U.S. Cl.

CPC . *A62C 33/00* (2013.01); *F04F 5/20* (2013.01); *A62C 33/02* (2013.01)

(58) Field of Classification Search

CPC ..... A62C 31/02; A62C 33/02; A62C 33/00; A62C 99/009; F16L 13/00; F04F 1/00; F04F 3/00; F04F 5/00; F04F 7/00; F04F 5/20; F04F 5/24; F04F 5/22; F04F 5/26; F04F 5/52

USPC ..... 417/53, 71, 76, 87, 90, 120, 145, 148, 417/158, 187, 193; 285/272, 280; 169/5

See application file for complete search history.

(56) References Cited

U.S. PATENT DOCUMENTS

| | | | | |
|---|---|---|---|---|
| 1,610,165 | A | 6/1925 | Shellin | |
| 1,648,816 | A | 7/1926 | Lumley | |
| 2,630,183 | A * | 3/1953 | Foutz | 169/15 |
| 4,640,461 | A * | 2/1987 | Williams | 239/317 |
| 5,137,094 | A * | 8/1992 | Broussard | 169/15 |
| 5,960,887 | A * | 10/1999 | Crabtree | 169/15 |
| 7,530,404 | B2 * | 5/2009 | Lenz, Jr. | 169/24 |
| 2005/0089408 | A1 * | 4/2005 | Solomon | 417/182 |
| 2007/0137716 | A1 * | 6/2007 | Stoops et al. | 137/893 |
| 2008/0135646 | A1 | 6/2008 | Wilkinson | |
| 2009/0232665 | A1 | 9/2009 | Goch et al. | |

* cited by examiner

*Primary Examiner* — Bryan Lettman

(74) *Attorney, Agent, or Firm* — Long & Chybik; John D. Long, Esq

(57) ABSTRACT

A fire hose adapter comprising a body and a vacuum generator. The body having a cap and a hose connector. The cap being penetrated by a generator channel that connects an intake port with an exhaust port, the two ports being located on an exterior of the cap. The hose connector defining a vacuum channel that continuously connects the generator channel to a vacuum aperture located on an exterior of the hose connector. The vacuum generator being located within the generator channel, wherein a stream of pressurized air passes through the vacuum generator causing a reduction in air pressure in the generator channel that subsequently induces air in an interior of a fire hose section connected to the hose connector to flow into the vacuum aperture and be directed out the exhaust port.

7 Claims, 4 Drawing Sheets

FIRE HOSE ADAPTER AND METHOD OF USE

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to devices and their methods that reduce amount of air present in a fire hose interior to generally place the fire hose in a more compact state for storage or transport. More specifically, the present invention may apply to those air reduction devices and their methods, wherein the said air reduction devices are pneumatically powered.

BACKGROUND

Responding to wild fires generally located in rural areas that have limited road access, firefighting vehicles may not be able to be bought proximate to the fire site to deliver the water to the fire. Rather, water from the water pumping system of the remotely-located firefighting vehicle may need to be delivered to the fire through continuously attached sections of fire hoses. Due to the wilderness area's generally difficult topography (e.g., hilly, shrub covered areas that may significantly resist or inhibit the pulling of connected sections of fire hose through such areas), firefighters may have to deploy in teams with each team member generally carrying one or more sections of fire hose in relay manner towards the fire site. In doing so, one member may attach an end of its hose section to a hose connection point of the water pumping system of a firefighting vehicle. As the relay team then progresses towards the fire site, the connected hose then pays out from that firefighter. Once that first section of fire hose is substantially fully paid out, another member of the team may connect that member's hose section to the unconnected end of the paid out first hose section. The relay team then resumes its movement towards the fire site as the connected second section of fire hose pays out from the second firefighter. This process generally repeats as the team(s) comes within sufficient proximity of the fire with continuously-connected sections assembled into a fire hose.

With the fire hose so assembled and connected to the firefighting vehicle, on-site firefighters may initiate communications with firefighting vehicle personnel to activate the water pumping system to pressurize the connected/completed fire hose or line with water to allow the firefighting team to commence firefighting activities at the fire site. After the fire(s) is(are) stricken or sufficiently ameliorated to allow firefighters to stand down the use of the assembled fire hose(s), the relay teams, after having the lines being depressurized, may disconnect the various fire hose sections and bring them back to the firefighting vehicle.

In one instance, each firefighter may transport one or more fire hose section(s) that have been tied together in nested horse shoe configuration with two of the loops of the configuration being used as shoulder straps allowing the firefighter to load the fire hose section(s) upon their backs with subsequent payout capability. In other instances, fire fighters may use fire hose carrying packs (e.g., soft-sided, backpack type containers) containing one or more fire hose sections. The carrying packs may contain fire hose section(s) that are substantially coil-wrapped or U-shape folded in a manner that allows for subsequent fire hose section payout from the pack. Both types of fire hose transport means substantially allow the firefighter's hands/arms to be generally free to help the firefighter to negotiate the wild land terrain as the firefighter proceeds with fire hose section(s) towards the fire site.

When the overall wild fire event has ended (e.g., the wild fire site[s] being sufficiently extinguished or otherwise placed under sufficient control), firefighter relay teams and their respective firefighting vehicles can return to their fire stations. At the station, the disconnected fire hose sections may first be dried out (e.g., raised to vertical position for draining, etc.) The fire hose sections may then be subject to a vacuum means to substantially remove air from their hollow interior to present them into a more compact state for placement into their carrying packs. This can be accomplished by sealing one end of the hose with a suitable sealing connector and securing the other end to a hand primer (e.g., a vacuum pump that may be primarily used for removing the air from [and subsequently allowing the introduction of water into] the water chamber of portable centrifugal water firefighting pump prior to its proper operation.) The hand primer may then be used to remove air from the hose section interior to collapse the hose section into a compacted state. Once placed in this compacted state, the hand primer and sealing connector may be removed, and the collapsed hose section may be folded or coiled for placement within its hose carrying pack.

In ongoing firefighting field operations, there may be time limitations or access constraints regarding the application of hand primer to fire hose sections to remove air from (e.g., induce a vacuum to) a fire hose section interior. Without the significant removal of air from the hose section interior, the hose section may not collapse into its compacted state that substantially allows it to be folded/coiled for subsequent placement into its respective carrying pack. In such instances, the hoses may instead need to be folded and tied by themselves sans fire hose packs, as previously described, for later firefighter transport to another fire site.

What may be needed is a simple, inexpensive, small, easy-to-transport hose adapter that could be pneumatically powered by a pressurized air supply (e.g., air brake system of a firefighting vehicle) to induce a vacuum to remove air from a fire hose section interior. This air removal could allow the hose section to be placed within a compacted state for subsequent loading into a respective carrying pack. Such an adapter and a method of use could provide for quick, easy, successive, and repeated loading of the fire hose into hose packs for successive transport and repeated deployment by firefighters at various fire sites within wilderness fire scene.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to remove air from within the interior of a fire hose to place it into a more compact state for storing into a soft-sided hose pack;

provide an simple, inexpensive, easy to carry fire hose adapter for inducing a vacuum that removes air from within the interior of a connected fire hose;

the ability to use the pressurized air supply to provide a means of reducing the amount of air in an fire hose;

provide a fire hose adapter that uses the air brake system of a firefighting vehicle to remove air from the interior of a fire hose, provide a fire hose adapter that creates a vacuum by a stream of air passing through the adapter to remove air from an interior of an attached fire hose;

the ability to power by compressed air a vacuum device for fire hoses; and provide a pneumatically-operated fire hose adapter that can be used on a firefighting site to remove air from a connected fire hose interior to place the said hose into a compact state for loading into a fire hose carrying pack.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a fire hose adapter comprising of a body and a vacuum generator, the body having a cap and a hose connector, the cap being penetrated by a generator channel that connects an intake port with an exhaust port, the two ports being located on an exterior of the cap; the hose connector capable of connecting to an open end of a fire hose, the hose connector further defining a vacuum channel that continuously connects the generator channel to a vacuum aperture located on an exterior of the hose connector; the vacuum generator being located within the generator channel, wherein a stream of pressurized air passes through the vacuum generator causing a reduction in air pressure in the generator channel that subsequently induces air in an interior of a fire hose section connected to the hose connector to flow into the vacuum aperture and be directed out the exhaust port.

Another possible embodiment of the invention could be a method of removing air from a fire hose interior comprising of the following steps, providing at least one fire hose section with a hollow interior that continuously connects two open ends; providing a fire hose adapter that reversibly connects to one open end of the fire hose section, wherein a stream of pressurized air passing through the fire hose adapter further induces air present in the interior of the fire hose section to pass through the fire hose adapter to exit to the external environment; connecting the fire hose adapter to the fire hose section to one of the open ends; and passing a stream of pressurized air through the fire hose adapter to cause the air present in the interior of the fire hose section to enter into and pass through the fire hose adapter to be subsequently ejected out to the external environment.

Yet another possible embodiment of the invention could be a fire hose adapter connected with a fire hose in further combination with pressurized air supply for reducing the amount of air in a fire hose interior in comprising of a fire hose adapter having a body and a vacuum generator; the body having a cap and a hose connector, the cap being penetrated by a generator channel that connects an intake port with an exhaust port, both ports being located on an exterior of the cap; the hose connector defining a vacuum channel penetrating the hose connector to continuously connect the generator channel to an vacuum aperture on the exterior of the hose connector body; the vacuum generator, the vacuum generator being located into the generator channel; a pressurized air supply connected to the intake port; at least one fire hose section whose hollow interior is continuously connected to two open ends, one open end reversibly sealed while the other open end is connected to the hose connector; wherein the pressurized air supply introduces a stream of pressurized air through the vacuum generator causing a reduction in air pressure within the generator channel subsequently inducing air in the interior of the fire hose section to flow into the vacuum aperture, through the vacuum channel, into the vacuum generator to further move with the stream of pressurized air to exit the vacuum generator and out the exhaust port to the external environment.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
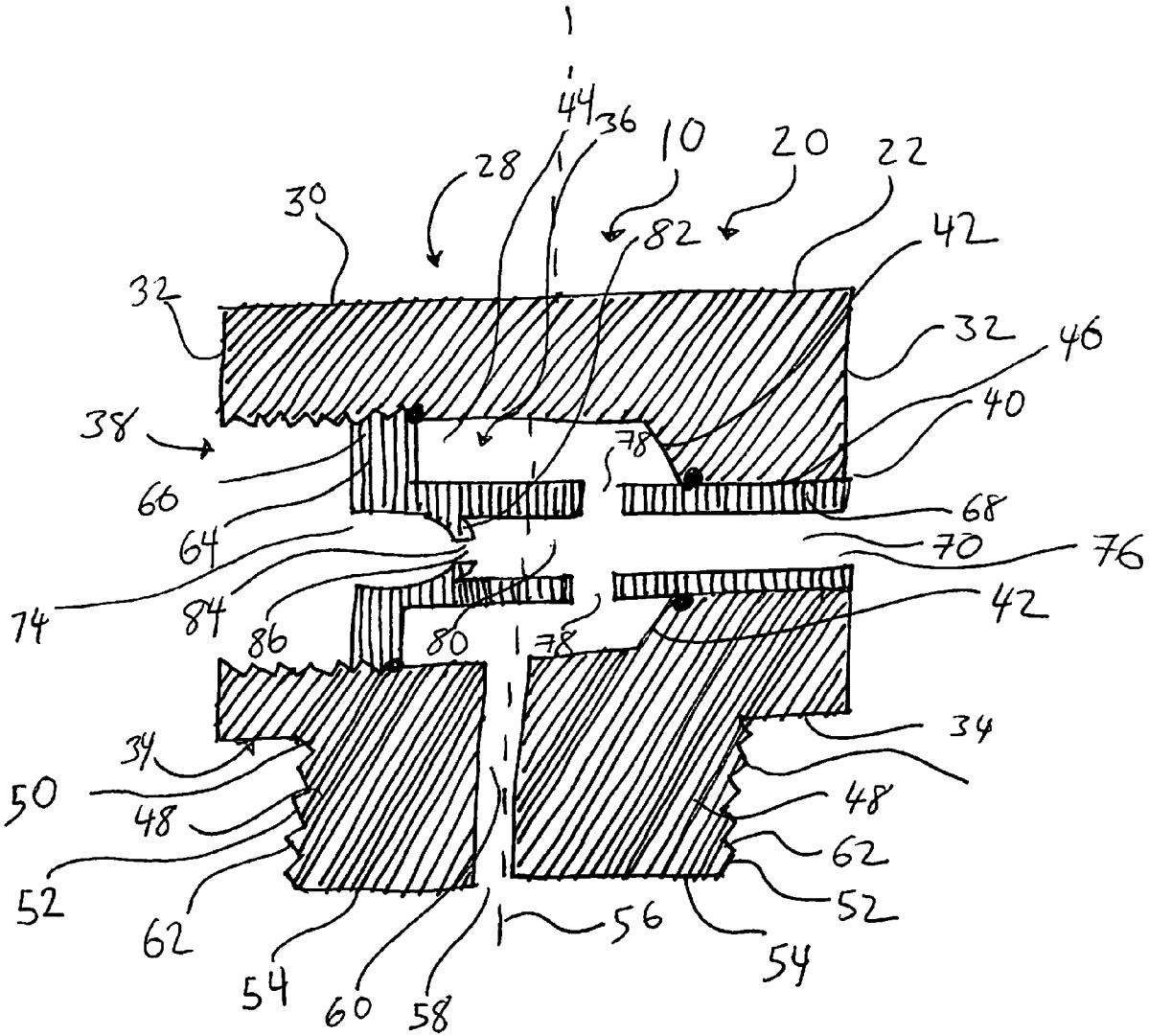
FIG. 1 is substantially an elevation cut-away view of one embodiment of the present invention.
Figure 2:
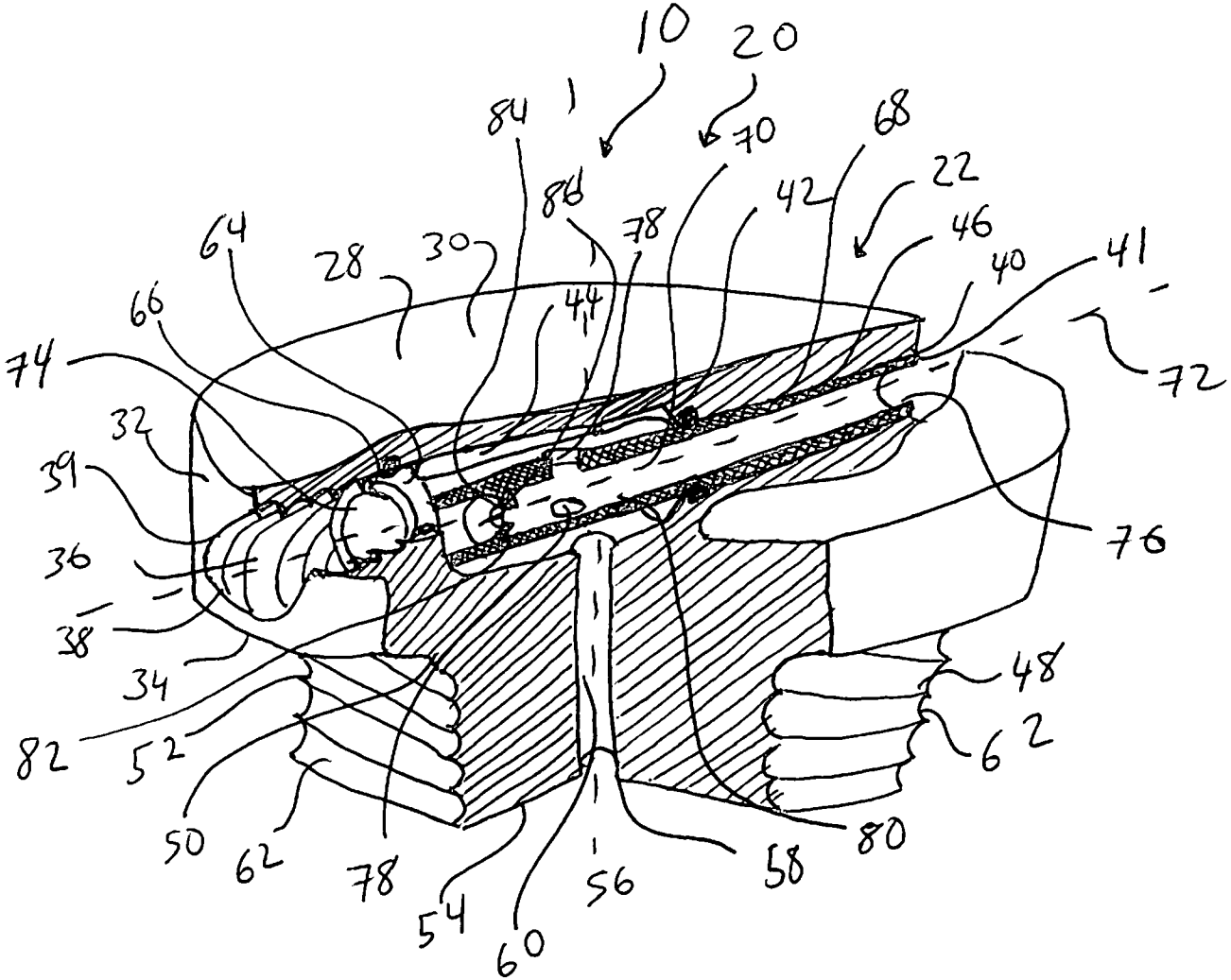
FIG. 2 is substantially a perspective cut-away view of one embodiment of the present invention.

The present invention 10 could comprise of fire hose adapter 20 that could be used to substantially remove air from the interior of a fire hose section 300 and a method 200 for the use of same. As substantially shown in FIGS. 1 and 2, the fire hose adapter 20 could be comprised of unitary body 22 made of a cap 28 and a hose connector 48, the cap 28 further containing a vacuum generator 64.

The cap 28 could be disk-shaped having a cap top 30 continuously connected by a cap side 32 to a cap bottom 34.

The cap 28 could be further penetrated by a generator channel 36 (into which the vacuum generator 64 could be seated) that continuously connects an intake port 38 with an exhaust port 40, the two ports connecting the exterior of the cap to the generator channel 36. Both ports 38, 40 could be located on the cap side 32 so as to be placed opposite (e.g., directly across from) from each other (e.g. the two ports generally being located 180° apart from one another on the cap side 32.) The intake port 38 could have a circumference with greater dimensions than the circumference of the exhaust port wherein the generator channel 36 transitions from the intake port circumference to a constriction shoulder 42 that narrows the generator channel 36 to dimensions of the smaller exhaust port circumference. The constriction shoulder 42 further effectively divides the generator channel 36 into a vacuum chamber 44 (denoted by the exhaust port 40 to the narrowest portion of the constriction shoulder 42), and an exhaust chamber 46 denoted from the constriction shoulder 42 to the exhaust port 40.

The hose connector 48 may also be disk or cylindrically-shaped with a connector top 50 continuously connected by a connector side 52 to a connector bottom 54. The body 22 being unitary, the cap bottom 34 generally meets the connector top 52 to allow the cap 28 and hose connector 48 share the same radial axis 56. The cap 28 may have a circumference that has greater dimensions than the circumference of the hose connector 48 to allow positive gripping of the cap 28 by the operator to fully manipulate the fire hose adapter 20 relative to the fire hose section 300. The connector bottom 54 may feature a vacuum aperture 58 continuously connected to a vacuum channel 60 that passes through hose connector 48 and at least a portion of the cap 28 to open into and be continuous with the vacuum chamber 44 to allow the hollow interior 302 of an attached fire hose section 300 to be substantially continuously connected to the generator channel 36.

The connector side 46 may feature one or more attachment mechanisms 62 that allow the body 22 to attach or connect to an open end 304 of fire hose section 300. In at least one version, attachment mechanism 62 may be threads that may interact with corresponding hose end threads to attach the fire hose adapter 20 to the fire hose section 300.

The vacuum generator 64 could be comprised of disk-shaped channel head 66 whose bottom is attached to an end of rod-shaped generator body 68. An air stream channel 70 substantially traveling along the radial (or longitudinal) generator axis 72 of the vacuum generator 64 penetrates both the generator head 66 and the generator body 68. The air stream channel 70 continuously connects an intake aperture 74 located on the top of the generator head 66 to an exhaust aperture 76 located on another end of the generator body 68. The air stream channel 70 further penetrates the generator body 68 by continuously connecting to one or more channel apertures 78 located along the side of the generator body 68.

The interior 80 of the air stream channel 70 forms a conical-shaped injector (or restrictor) 82 within body 68 of the vacuum generator 64. This injector 82 generally reduces or restricts the passage of the air stream channel 70 from the size of the circumference of the intake aperture 74 to a significantly smaller circumference of the injector aperture 84 located in the conical tip 86 of the injector 82. The outside of the conical tip 86 curves back to meet the interior wall of the generator 64 denoting the air stream channel 70. Generally, speaking the channel aperture(s) 78 are located downstream of injector 82 but upstream of where the vacuum generator 64 engages the constriction shoulder 42.

When the vacuum generator 64 is placed through the intake port 38 to be properly lodged within the generator channel 36, the vacuum head 66 fits into the intake port 38 (and can be sealed by O-ring[s] and respective O-ring channel[s]) while the unattached end of the vacuum body 68 could be received into exhaust chamber 46 of the generator channel 36 (and can be sealed by O-ring[s] and respective O-ring channel[s].)

Figure 3:
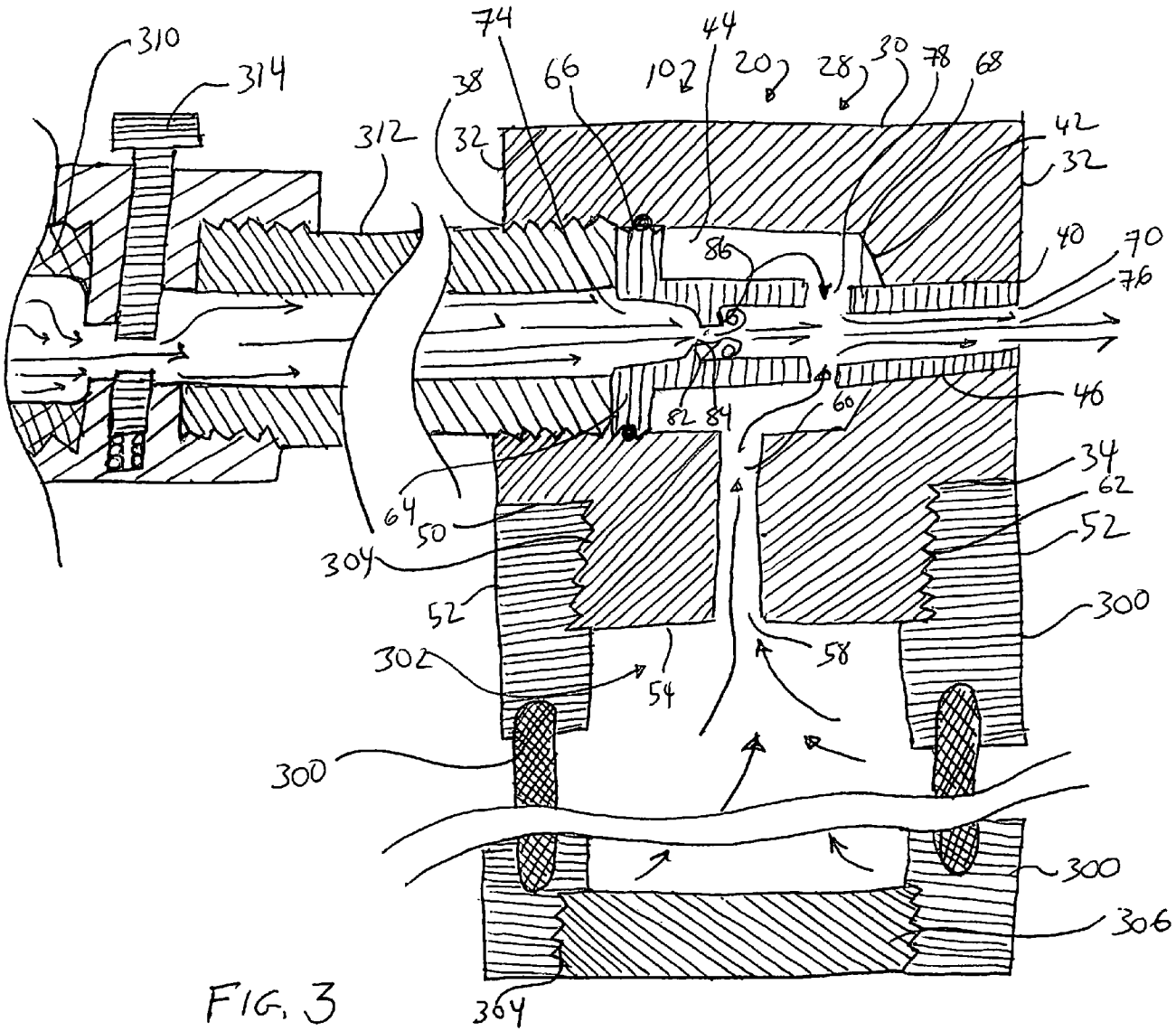
FIG. 3 is substantially an elevation cut-away of the present invention showing general movement of air through the combination of the invention, fire hose section, and pressurized air supply system.

As substantially shown in FIG. 3, during operations, a sealing connector 306 could attach to and substantially seal off one open end 304 of a fire hose section 300. The fire hose adapter 20 could be affixed to the other open end 304 of the fire hose section 300. A suitable connector hose 312 with an air pressure control device 314 for controlling passage of pressurized air (e.g., a hand-operated air valve) going into the fire hose adapter 20. The connector hose 312 could have its ends suitably adapted for attachment to a pressurized or compressed air supply 314 (e.g., the air brake system of a fire-fighting vehicle) and the fire hose adapter 20 (utilizing standard pneumatic connectors to make such attachments.) The connector hose 312 could connect at one end to the pressurized air supply provided by the air brake system of the fire-fighting vehicle 310 and at the other end to fire hose adapter 20. When the air pressure control device 314 is activated, pressurized air from the pressurized air supply is introduced into the hose adapter 20 to create an air stream flowing through the air stream channel 70 which in turn induces air in the fire hose interior 302 to enter the fire hose adapter 20 through vacuum aperture 58 and be expelled through the exhaust port 40 into the external environment along with the air stream.

Figure 4:
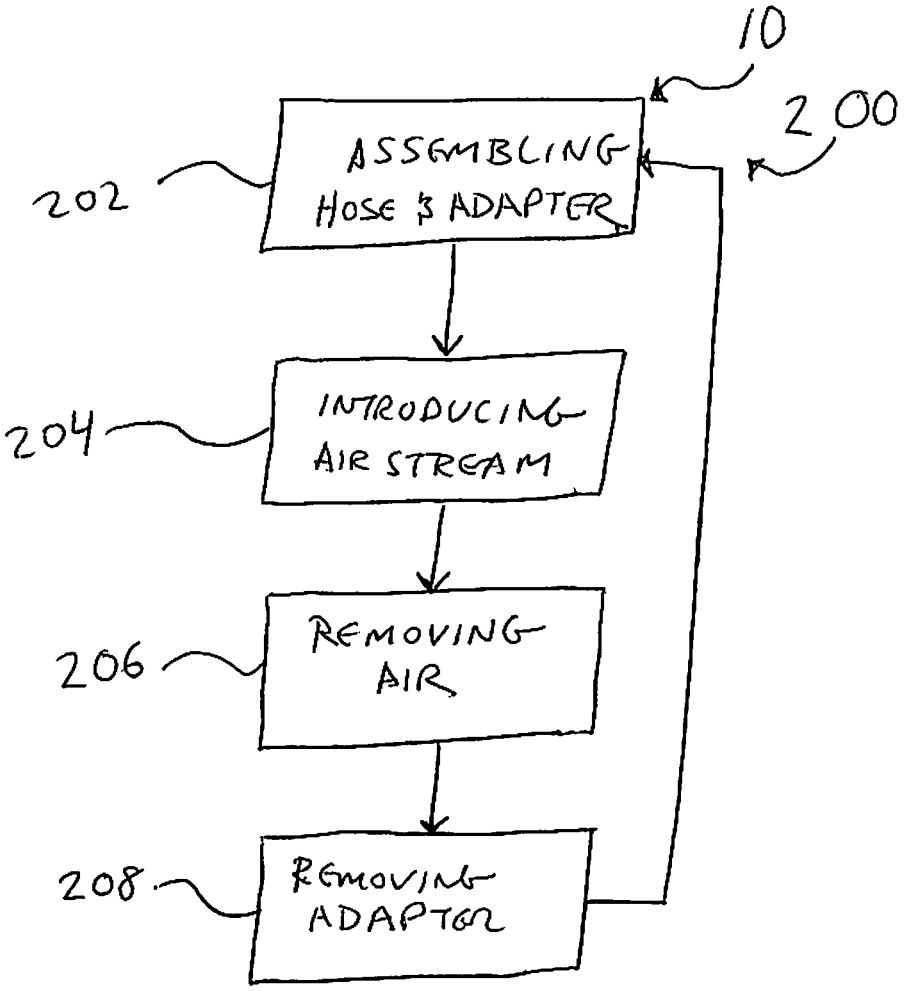
FIG. 4 is substantially a flow chart showing one possible embodiment for a method of operating the invention.

As substantially shown in FIG. 4, the process or method 200 of operating the fire hose adapter 20 could proceed with step 202 assembling the hose and adapter together. The adapter operations in one embodiment could occur at wild land/wilderness fire site, where a firefighter, also proximate to fire fighting vehicle with a pressurized air supply could be reconstituting a fire hose/hose carrying pack combination. The firefighter, or other operator, could attach a sealing connector to one end of a fire hose section for a generally air tight seal. The firefighter could then attach the fire hose adapter to the other end of the selected fire hose section. A suitable connector hose with an intervening control valve can then be used to connect the fire hose adapter by its intake aperture (e.g., utilizing an attachment with suitable threads and/or standard pneumatic connectors) to an air nib/pneumatic connector attached to the pressurized air supply (e.g., the air brake system of the firefighting vehicle.) Once this step is substantially completed, the process can continue to step 204, introducing an air stream into the adapter.

In step 204, introducing an air stream into the adapter, the pressurized air supply pressurizes the connector hose, the operator can active the control valve to allow pressurized (compressed) air from the pressurized air supply (e.g. air brake system) into the air stream channel. As the air stream travels downstream through the air stream channel to the conical injector, the conical injector could take the lower pressure air stream and by forcing/speeding the air stream through a narrower passage of the injector aperture will cause the emitted air stream travel at a higher speed. As this smaller air stream of higher speed is emitted from the conical aperture, it could continue downstream through the air stream channel to exit out the exhaust aperture and subsequently from the cap/exhaust port to the external environment. The travel of the air stream through the generator could result in a low pressure area (e.g., vacuum) created proximate to the tip of the conical injector and the walls of the air stream channel. As the process in step 204 is substantially completed, the process 200 could continue onto step 206, removing air in the fire hose interior.

In step 206, removing air from the fire hose interior, the low air pressure area could also be proximate to channel aperture(s) penetrating the sides of the vacuum generator to generally connect the air stream channel interior to the vacuum chamber. This could induce air in the vacuum chamber to move into air stream channel to travel with the air stream out of the cap. As air is removed from the vacuum chamber, air within the connected fire hose interior could move into the vacuum aperture, through the vacuum channel, and into the vacuum chamber to continuously replace the air that was previously removed from the vacuum chamber by the movement of the air stream. As air from the fire hose interior is continually removed by the invention (e.g., a vacuum is created in the fire hose interior), the process will continue until the efficiency of the adapter operation is generally counterbalanced. External atmospheric pressure upon the outside of the hose section could compress its walls together, placing the fire hose section into a compacted state. When step 206 is substantially completed, the process 200 could continue onto step 208, removal of the adapter.

In step 208, removing adapter, after the fire hose section has been compacted, it can then folded and/or rolled into its storage state and place in its respective carrying pack. At that point the pressurized air supply can be disconnected from the hose adapter (e.g., after releasing the handle of the connector control valve/disrupting the air stream) to allow created vacuum to be dissipated for easy removal of the adapter from the fire hose. The process 200 could then substantially return to step 202 for processing of additional fire hoses.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As seen in this application, the invention could be a fire hose adapter for removing air from the interior of a fire hose section for placing the section into a more compact state for storage/transport within a soft-sided hose pack. The adapter is of simple, inexpensive, easy-to-carry construction that is pneumatically powered through the air brake system of a firefighting vehicle. The adapter creates a low air pressure area induced by an air stream passing through the generator; the low air pressure area generally moves air from the fire hose interior into the fire hose adapter to move with the air stream to subsequently leave the fire hose adapter to vent to the external environment outside the adapter.

What is claimed is:

1. A process of removing air from a fire hose interior comprising the following steps, but not necessarily in the order shown:

(A) providing at least one fire hose section with a hollow interior that continuously connects two open ends;

(B) providing a fire hose adapter that reversibly connects to one open end of the fire hose section, wherein a stream of pressurized air passing through the fire hose adapter further induces air present in the interior of the fire hose section to pass through the fire hose adapter to exit to an external environment;

(C) connecting the fire hose adapter to the fire hose section at one of the open ends;

(D) sealing the remaining open end in a manner that prevents the passage of any fluid or gas through the sealed remaining open end and into the hollow interior; and (E) passing the stream of pressurized air through the fire hose adapter to cause the air present in the interior of the fire hose section to enter into and pass through the fire hose adapter to be subsequently ejected out to the external environment to collapse the fire hose into a compacted state.

2. The process of claim 1 wherein passing the stream of pressurized air further comprises a step of generating a pressurized air supply through an air brake system of a firefighting vehicle.

3. The process of claim 1 wherein the passing of a stream of pressurized air further comprises a step of creating an area of low air pressure within a generator channel.

4. The process of claim 3 wherein the step of creating an area of low air pressure within the fire hose adapter further comprises a step of moving the air of the fire hose section interior proximate to the stream of pressurized air.

5. The process of claim 4 wherein the step of moving the air of the fire hose interior further comprises a step of exhausting the air of the fire hose interior together with the pressurized air stream to the external environment.

6. The method of claim 1 wherein the passing the stream of pressurized air further comprises of the step of moving the stream of pressurized air through an intake port, onto an intake aperture and through an air stream channel thereby creating a low air pressure area proximate to at least one channel aperture.

7. The method of claim 6 wherein the creating of the low air pressure area further comprises a step of causing air from the interior of the fire hose section to pass into a vacuum aperture, through a vacuum channel, into the vacuum chamber, then through the channel aperture, and then into the air stream channel to subsequently exit an exhaust aperture to vent out to the external environment.

* * * * *